US006103963A

United States Patent [19]

Nakamura et al.

[11] Patent Number: 6,103,963

[45] Date of Patent: Aug. 15, 2000

[54] PAGE TURNING APPARATUS

[75] Inventors: Hirokatsu Nakamura; Susumu Orihara, both of Kawasaki, Japan

[73] Assignee: Fujitsu Limited, Kawasaki, Japan

[21] Appl. No.: 09/013,256

[22] Filed: Jan. 26, 1998

[30] Foreign Application Priority Data

Feb. 7, 1997 [JP] Japan ..... 9-177227

[51] Int. Cl.[7] ..... G10G 7/00

[52] U.S. Cl. ..... 84/486; 84/487

[58] Field of Search ..... 84/486, 487

[56] References Cited

U.S. PATENT DOCUMENTS

| | | | |
|---|---|---|---|
| 4,545,141 | 10/1985 | It et al. | 40/531 |
| 4,691,909 | 9/1987 | Owada et al. | 270/58 |
| 5,471,277 | 11/1995 | Fujioka et al. | 355/25 |

FOREIGN PATENT DOCUMENTS

| | | |
|---|---|---|
| 0 235 458 A2 | 9/1987 | European Pat. Off. . |
| 0 398 516 A2 | 11/1990 | European Pat. Off. . |
| 9-142059 | 6/1997 | Japan . |

*Primary Examiner*—Robert E. Nappi
*Assistant Examiner*—Kim Lockett
*Attorney, Agent, or Firm*—Armstrong, Westerman, Hattori, McLeland and Naughton

[57] ABSTRACT

Disclosed is a page turning apparatus for turning over a page of a medium. This page turning apparatus comprises a drive roller for turning over a page of the medium and carries the medium on a carrier path, a pressing roller, a carrier motor for driving the drive roller, a movable panel for bending the medium, a clamping member for clamping the medium, a driving member for driving the pressing roller, the movable panel and the clamping member, and a control circuit for controlling the driving member and the carrier motor. The control circuit has a page turning mode for retreating the pressing roller, protruding the movable panel and the clamping member, and driving the drive roller, and a carrier mode for pushing the pressing roller against the drive roller, retreating the movable panel and the clamping member, and carrying the medium by the drive roller. The single motor thereby works to turn over the page of the medium and to carry the medium.

8 Claims, 10 Drawing Sheets

PAGE TURNING APPARATUS

BACKGROUND OF THE INVENTION

1. Field of the Invention

The present invention relates generally to a page turning apparatus for turning over a page of a medium such as a banknote etc and, more particularly, to a page turning apparatus constructed in a small size.

2. Description of the Related Art

An ATM (Automatic Teller Machine) and a teller machine are utilized in a financial institute etc. This type apparatus is provided with a banknote printer for printing a result of transaction on a banknote. This banknote printer incorporates a page turning mechanism for automatically turning over a next page when the page in the banknote is terminated by printing.

This page turning mechanism is capable of automatically carrying out the operation of turning over the page when terminated by printing. Consequently, a processing time can be reduced. It is desired that such a page turning apparatus be capable of turning over the page with a simple construction.

FIG. 10 is an explanatory diagram showing a prior art.

As illustrated in FIG. 10, a banknote PB is sandwiched in between a first feed roller 90 and a pinch roller 91 and carried in an arrowed direction A in FIG. 10. The page turning mechanism is provided with a page turning roller 94 and a feed roller 92 at an interval substantially corresponding to a length of one page of the banknote PB. A pinch roller 95 is disposed in a face-to-face relationship with the page turning roller 94, and a pinch roller 93 is disposed facing to the feed roller 92.

Provided between the pinch rollers 95, 93 are a presser 102 and a magnet 101 for moving the presser 102 up and down. The pinch rollers 95, 93 are moved up and down by up-and-down moving mechanisms 99, 100. A movable guide plate 98 is rotatably attached to a shaft of the feed roller 92. The magnet 101 pushes the banknote PB up, thereby bending the banknote. Following up this action, the movable guide plate 98 rotates.

A first sensor 103 is intercepted by an intercepting plate 98*a* of the movable guide plate 98. The first sensor 103 detects a maximum position of the page of the banknote that should be turned over. A second sensor 104 is intercepted by the intercepting plate 98*a* of the movable guide plate 98 and detects that the page of the banknote has been leafed up. The page turning roller 94 is driven by a first motor 96. The feed roller 92 is driven by a second motor 97.

An operation of this construction will be explained. The banknote PB is carried in an arrowed direction A so that the page is turned over. The banknote PB stops in a position where the banknote PB is held by the page turning roller 94 and the pinch roller 95, and by the roller 92 and the pinch roller 93.

Next, the pinch rollers 95, 93 are moved away from the rollers 94, 92 by the up-and-down moving mechanisms 99, 100. The banknote is thereby released from being held by those rollers. In this state, the presser 102 is raised. The banknote PB is thereby bent.

The pinch rollers 95, 93 are pushed up by the up-and-down moving mechanisms 99, 100, and the banknote PB is thus held. Then, the page turning motor 94 is rotated by driving the first motor 96. The feed roller 92 does not rotate, and hence the page that should be turned over swells out due to a friction between the page turning roller 94 and the page surface of the banknote. As the page swells out, the movable guide plate 98 is pushed up.

The page swells out, and, when the movable guide plate 98 intercepts the first sensor 103, it is judged that the swelling of the page reaches to the maximum position. When the first sensor 103 detects the movable guide plate 98, the presser 102 is moved down. Then, the pinch roller 95 is moved away therefrom by the up-and-down moving mechanism 99. With this operation, only the page to be turned over remains swollen, and other pages remain flat.

The page turning roller 94 is rotated in the page turning direction. The swollen page is thereby leafed up. The movable guide plate 98 intercepts the second sensor 104, thereby detecting that the page is leafed up. With this operation, the rotation of the page turning roller 94 is stopped.

Next, the feed roller 92 is rotated, whereby the banknote PB is rotated in the right direction in the Figure. The page leafed up is thereby turned over. Then, the banknote PB is carried to a printing mechanism positioned in the right direction in the Figure.

According o the prior art, the page turning operation is conducted by both of the page turning roller 94 and the feed roller 92 in cooperation with each other. This therefore requires the motor for the page turning roller and the motor for the feed roller. Further, the page turning mechanism needs the feed roller, and therefore a multiplicity of members of the feed motor, the pinch roller and the driving mechanisms are required.

Consequently, there arises a problem in which the cost increases with a greater number of parts. Moreover, the larger number of parts might cause a problem in which a space for the mechanism units becomes large enough to increase a size of the apparatus as a whole.

SUMMARY OF THE INVENTION

It is a primary object of the present invention to provide a page turning apparatus capable of reducing the number of parts for turning a page.

It is another object of the present invention to provide a page turning apparatus so constructed as to decrease the number of parts enough to reduce costs.

It is still another object of the present invention to provide a page turning apparatus capable of its being downsized with a decrease in the number of parts.

To accomplish the objects given above, according to the present invention, a page turning apparatus comprises a drive roller for turning over a page of the medium and carries the medium on a carrier path, a pressing roller movable between a position in which it is positioned away from the drive roller and a position in which it is pushed against the drive roller, a carrier motor for driving the drive roller, a movable panel movable between a position in which it is positioned away from the carrier path and a position in which it protrudes onto the carrier path in order to bend the medium, a clamping member movable between a position in which it is positioned away from the carrier path and a position in which it protrudes onto the carrier path in order to clamp the medium, a driving unit for driving the pressing roller, the movable panel and the clamping member, and a control unit for controlling the driving unit and the carrier motor. The control unit has a page turning mode for controlling the driving unit so as to protrude the movable panel and the clamping member as well, and controlling the carrier motor so as to drive the drive roller, and a carrier mode for controlling the driving unit so as to press the pressing roller against the drive roller and retreat the movable panel and the clamping member as well, and controlling the carrier motor so that the medium is carried by the drive roller.

According to the present invention, a feed roller mechanism of the page turning apparatus is constructed of a simple mechanism. Therefore, according to the present invention, a clamping mechanism is provided as a substitute for the feed roller. Then, the page turning motor is constructed to perform an operation of the carrier roller. The simply constructed clamping mechanism is provided in place of the feed roller mechanism, and hence the number of parts can be largely reduced. Further, the page turning roller is constructed to execute the feeding operation, and therefore the feeding motor can be eliminated, which largely decreases the number of parts. Owing to the abovementioned, the costs can be decreased, and the apparatus can be downsized.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1:
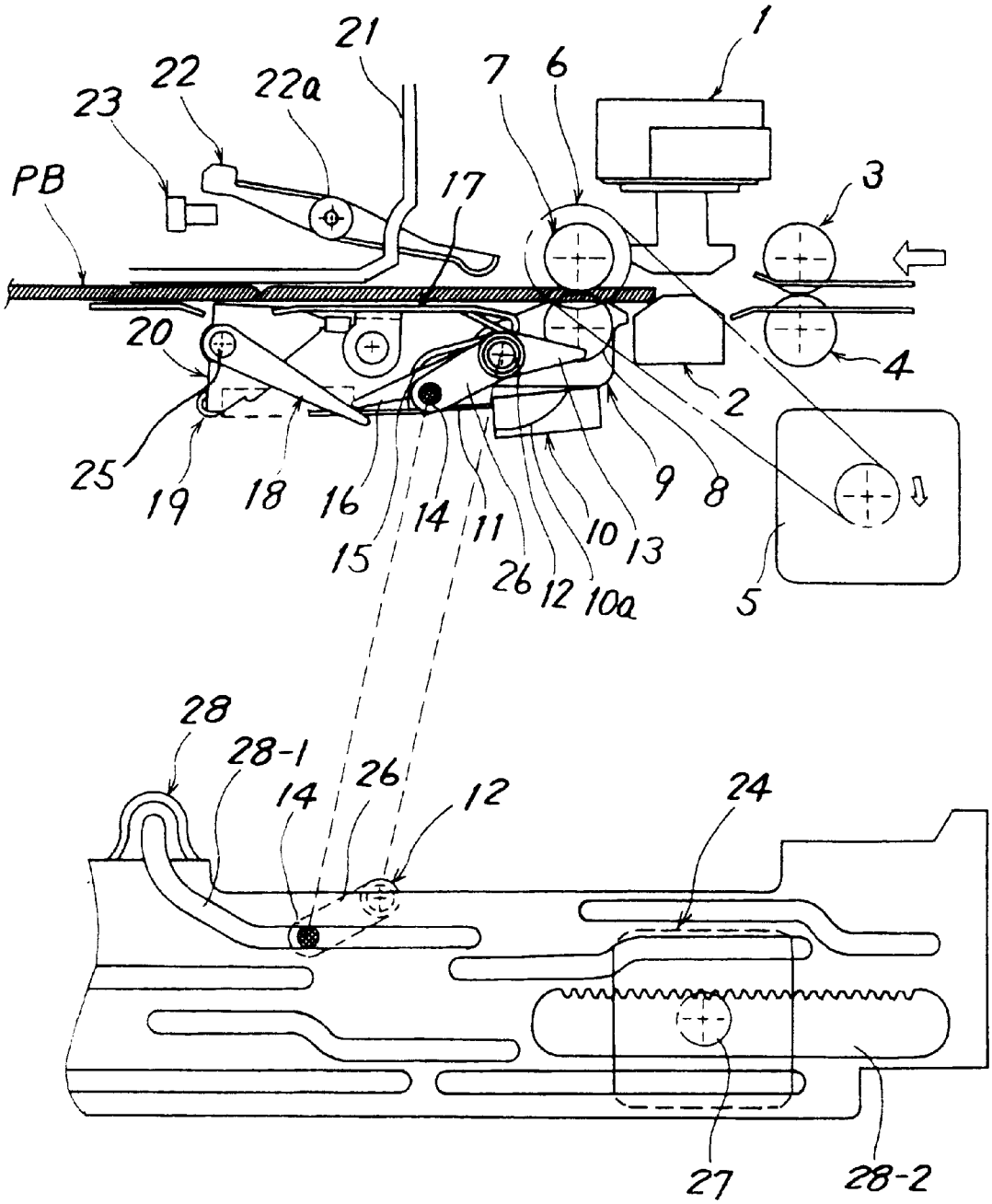
FIG. 1 is a view showing a construction of a banknote printer in one embodiment of the present invention.
Figure 2:
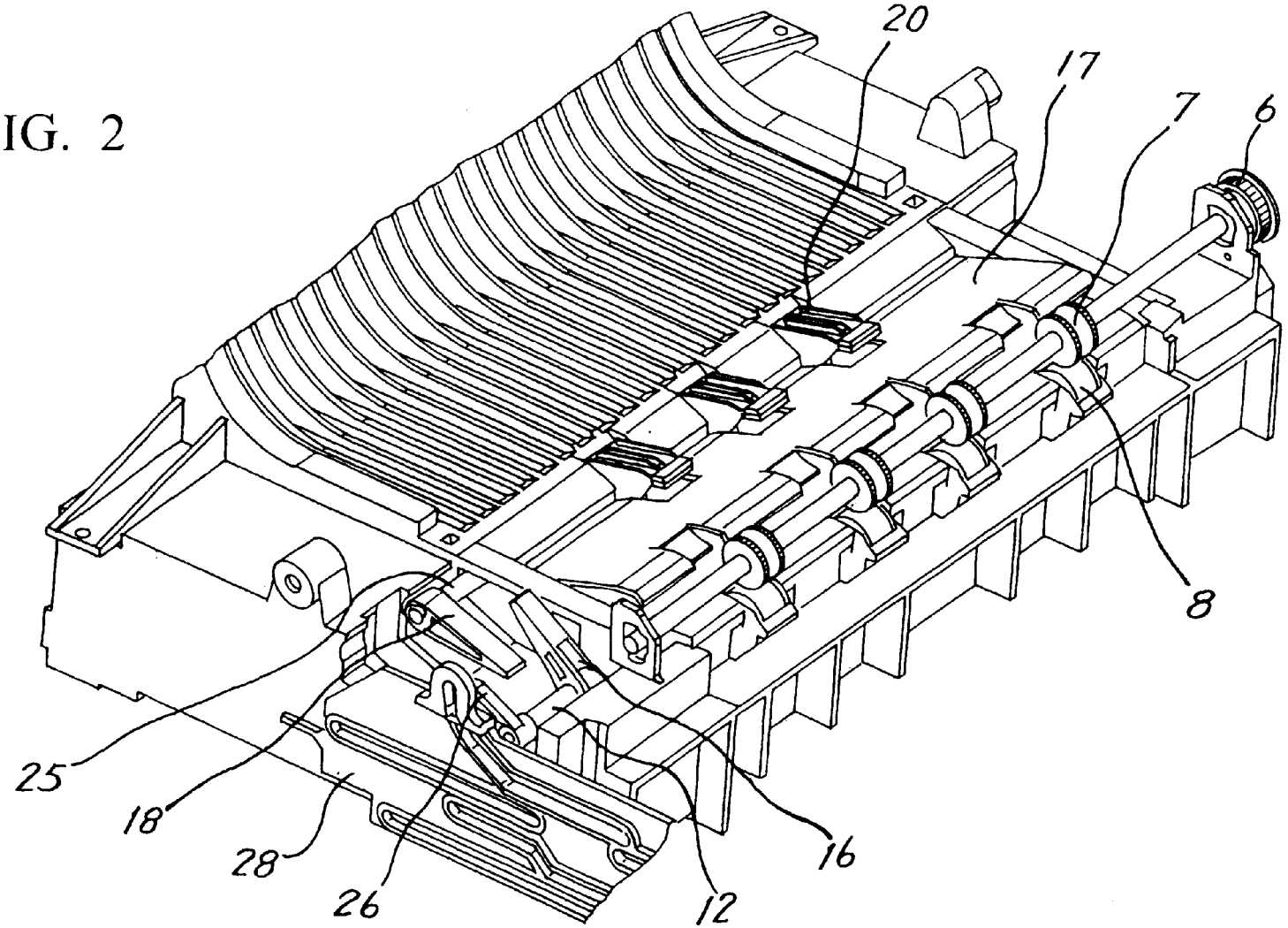
FIG. 2 is a perspective view of the banknote printer in the construction shown in FIG. 1.
Figure 3:
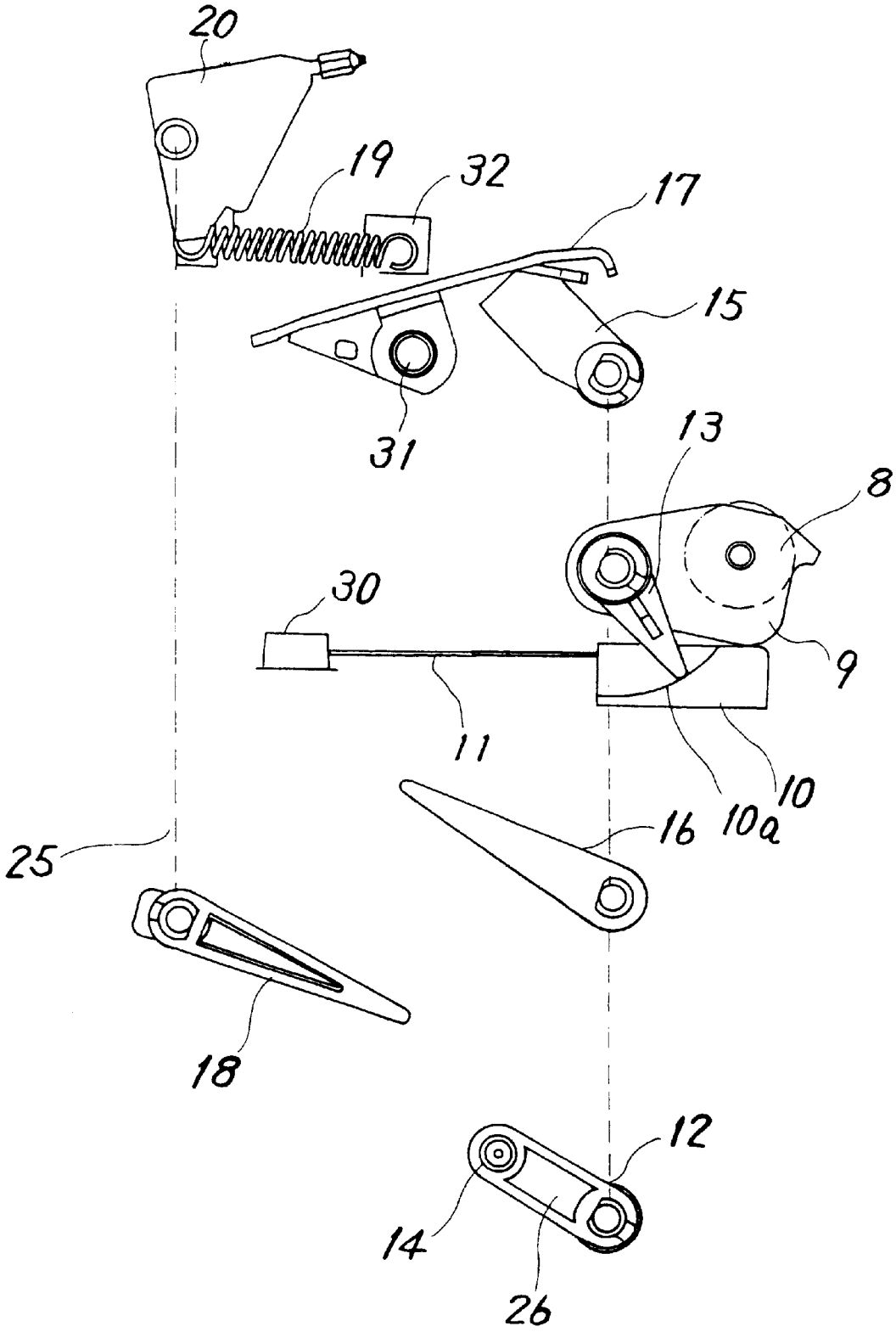
FIG. 3 is an exploded view of an interlocking mechanism in the construction shown in FIG. 1.

FIG. 1 is a diagram illustrating a construction of a banknote printer in one embodiment of the present invention. FIG. 2 is a perspective view showing the banknote printer. FIG. 3 is an exploded view of an interlocking mechanism in FIG. 1.

As illustrated in FIG. 1, a printing head 1 prints on a banknote PB inserted in an arrowed direction in FIG. 1. The reference numeral 2 designates a platen. A feed roller 3 and a pinch roller 4 carry the banknote PB inserted.

A pulley 6 is provided on a rotary shaft of a page turning roller 7. A page turning motor 4 drives the pulley 6 through a belt. Accordingly, the page turning roller 7 is rotated by the page turning roller 4. A pinch roller 8 is provided in a face-to-face relationship with the page turning roller 7. A holder 9 holds the pinch roller 8 rotatably.

The holder 9 is rotatably supported by a driving shaft 12. A pressing block 10 presses the holder 8 upwards in FIG. 1. A plate spring 11 imparts a biasing force acting upward in FIG. 1. A first lever 13 is fixed to the driving shaft 12. The first lever 13 engages with a guide 10*a* of the pressing block 10 and thus pushes the pressing block 10 down.

The driving shaft 12 is provided with a driving lever 26. A guide protrusion 14 is provided at a tip of the driving lever 26. A plate cam 28 is formed with a guide hole 28-1 into which the guide protrusion 14 is inserted, and a drive hole 28-2. The drive hole 28 is formed with a gear. This gear meshes with a gear 27 of a cam driving motor 24. Accordingly, with rotations of the cam driving motor 24, the plate cam 28 moves in bilateral directions in FIG. 1. With a movement of the plate cam 28, the guide protrusion 14 moves along the guide hole 28-1. Therefore, the drive lever 26 rotates, thereby rotating the driving shaft 12.

A movable panel 17 is rotatable about a shaft 31 (see FIG. 3). A second lever 15 is fixed to the driving shaft 12. The second lever 15 rotates the movable panel 17. The movable panel 17 thereby makes the banknote PB bent.

A third lever 16 is fixed to the driving shaft 12. A tip of the third lever 16 is linked to a fourth lever 18. The fourth lever 18 is fixed to a rotary shaft 25. The rotary shaft 25 is provided with a clamp member 20. A spring 19 works to rotate the clamp member 20 counterclockwise about the rotary shaft 25.

A printer frame 21 forms a carrier guide. The clamp member 20 sets the banknote PB between the printer frame 21 and the member 20 itself, and clamps the banknote PB. A sensor lever 22 rotates about a rotary shaft 22*a*. A photo sensor 23 detects an edge of the sensor lever 22, thus detecting a position of the sensor lever 22.

As illustrated in FIGS. 2 and 3, a tip of the rotary shaft 25 is provided with a fourth lever 18. The rotary shaft 25 is provided with the clamp member 20. The clamp member 22 is biased counterclockwise by the spring 19. An end of the spring 19 is fixed to a fixing block 32.

The drive lever 26 is provided at the end of the driving shaft 12. A tip of the drive lever 26 is provided with a guide member 14. The guide member 14 engages with the guide hole 28-1 of the plate cam 28. The drive shaft 12 is provided with the third lever 16.

Further, the drive shaft 12 is provided with the first lever 13. The holder 9 is rotatably supported on the drive shaft 12. The holder 9 is provided with the pinch roller 8. The pressing block 10 includes a guide 10*a*. The first lever 13 moves along the guide 10*a* of the pressing block 10. The pressing block 10 is biased upward by the plate spring 11. An end of the plate spring 11 is fixed to the fixing block 30.

The second lever 15 is fixed to the drive shaft 12. The second lever 15 rotates the movable guide 17 counterclockwise. The movable panel 17 is rotatable about the rotary shaft 31.

Figure 4:
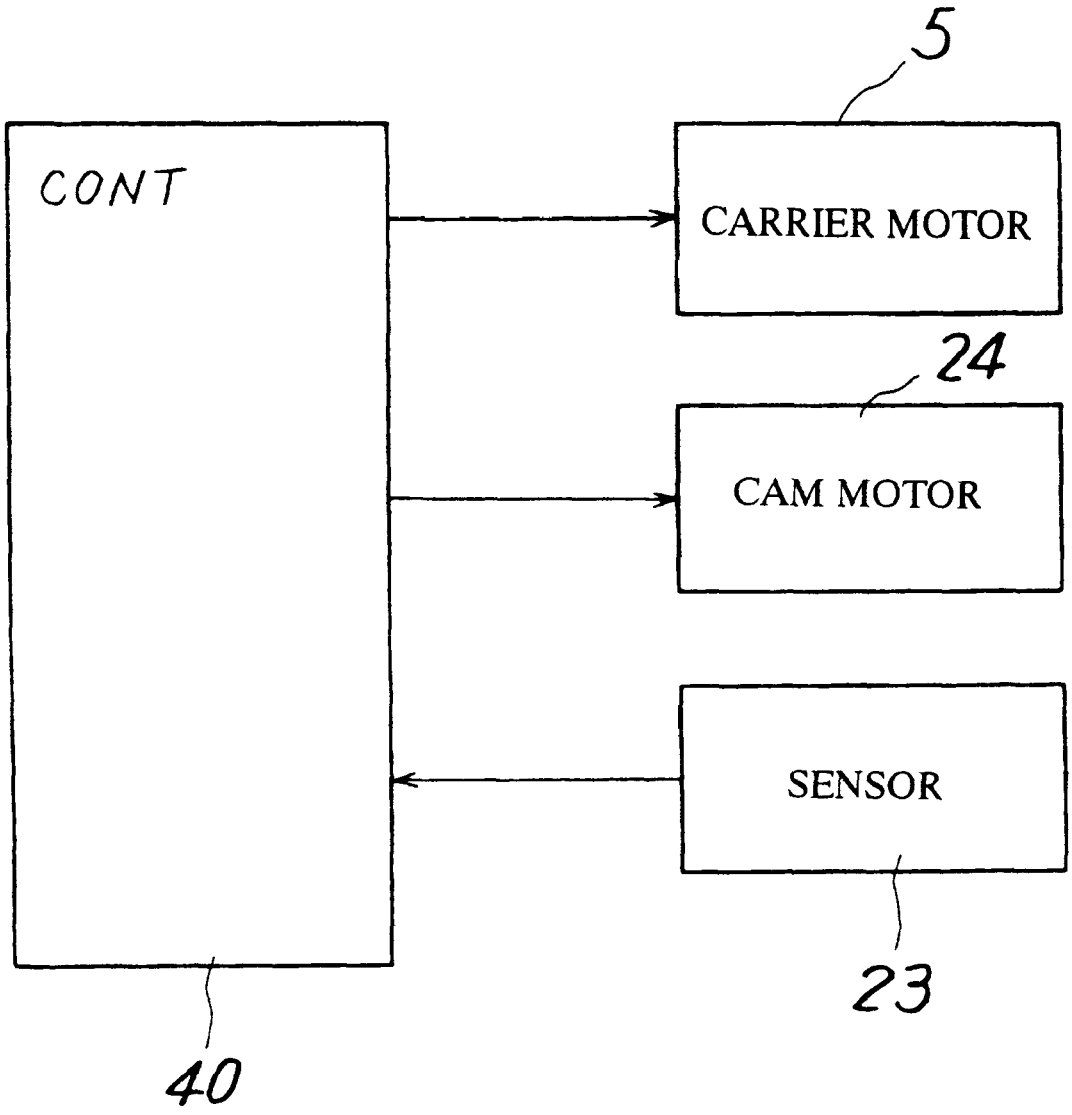
FIG. 4 is a block diagram showing one embodiment of the present invention.

FIG. 4 is a block diagram showing one embodiment of the present invention.

A control unit 40 is constructed of a microprocessor. The control unit 40, upon receiving an output of the photo sensor 23, controls the carrier motor 5 and the cam motor 24 .

Figure 5:
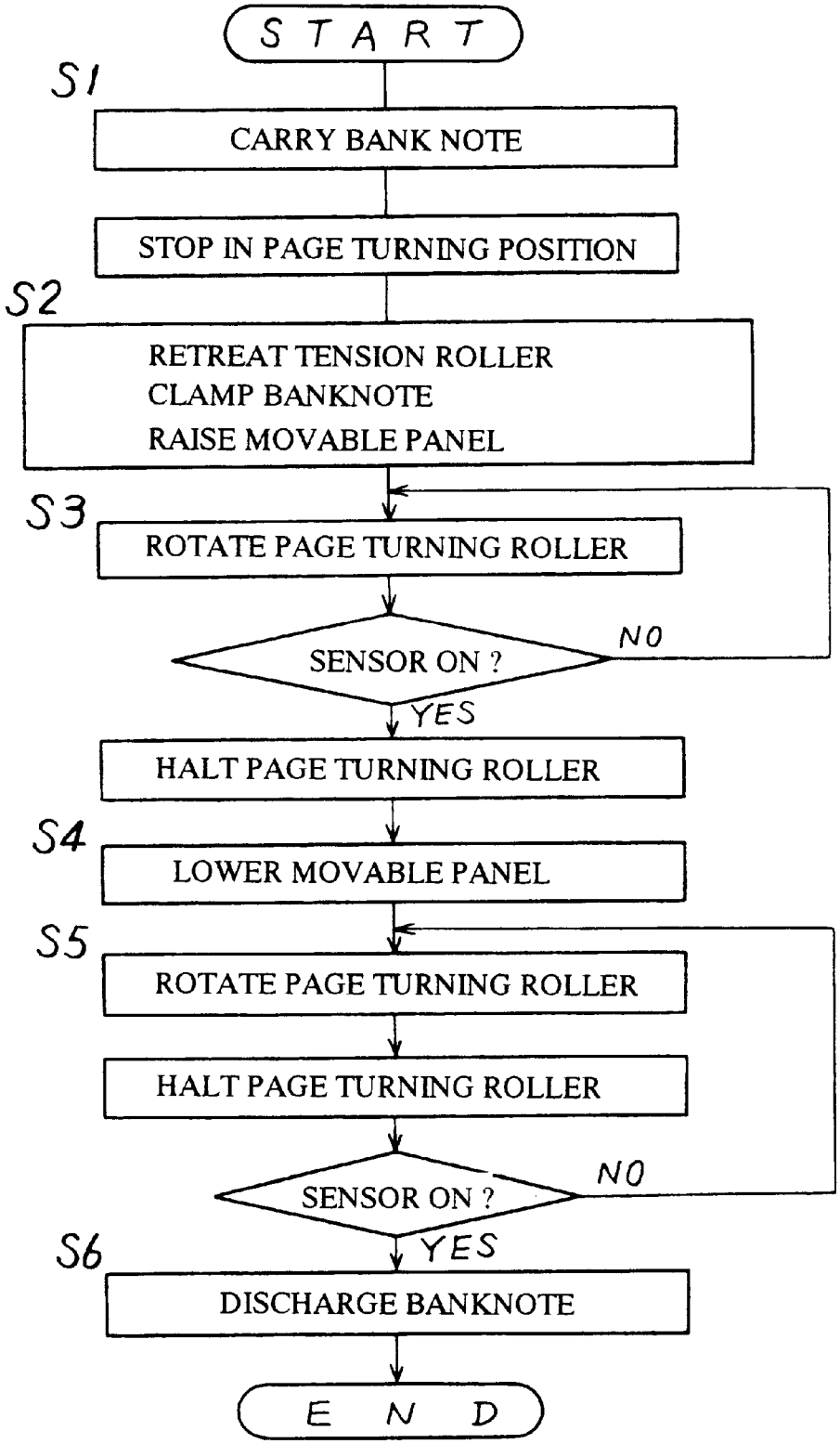
FIG. 5 is a flowchart showing an operation in one embodiment of the present invention.
Figure 6:
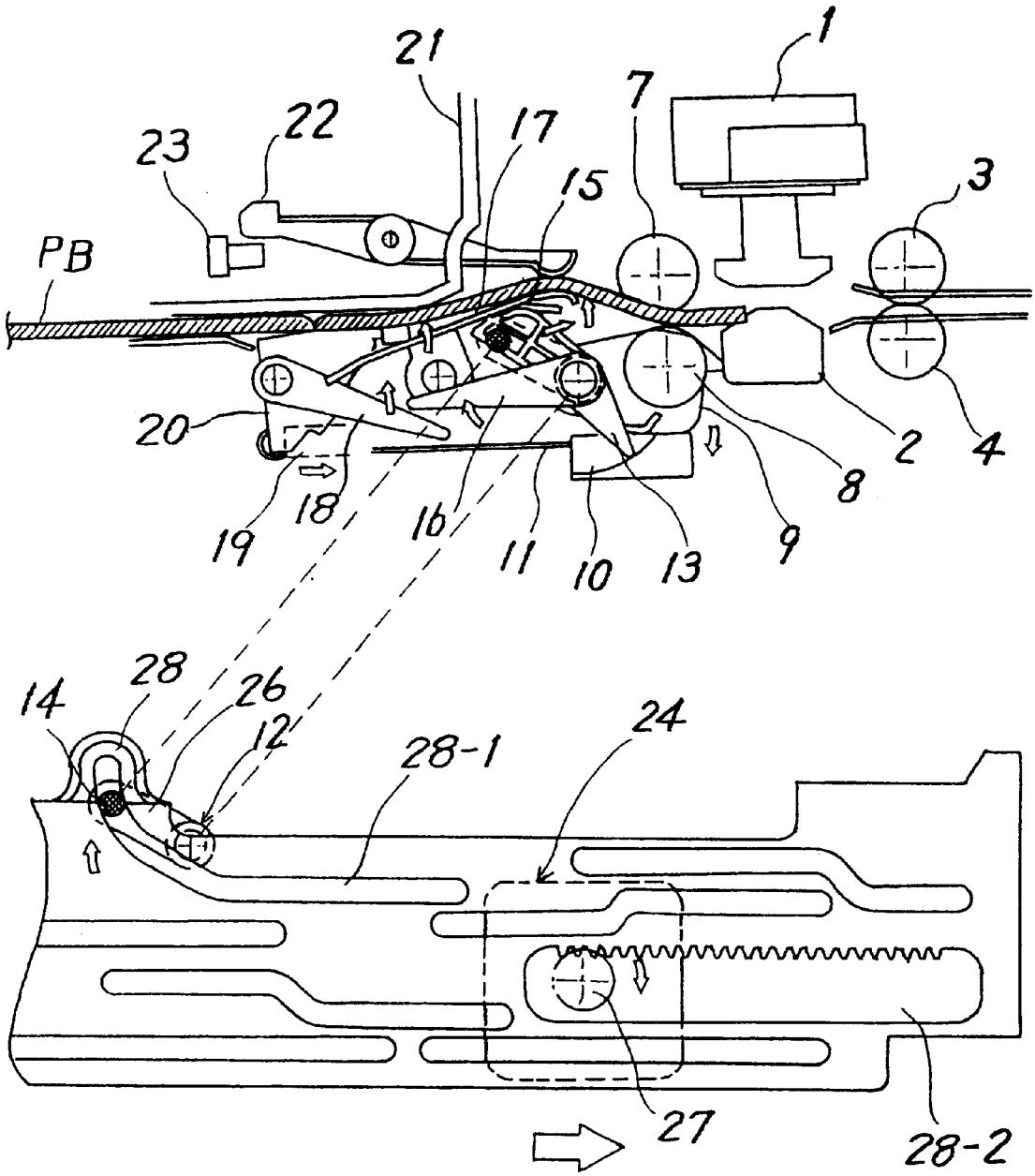
FIG. 6 is an explanatory view showing the operation in one embodiment of the present invention (part 1)
Figure 7:
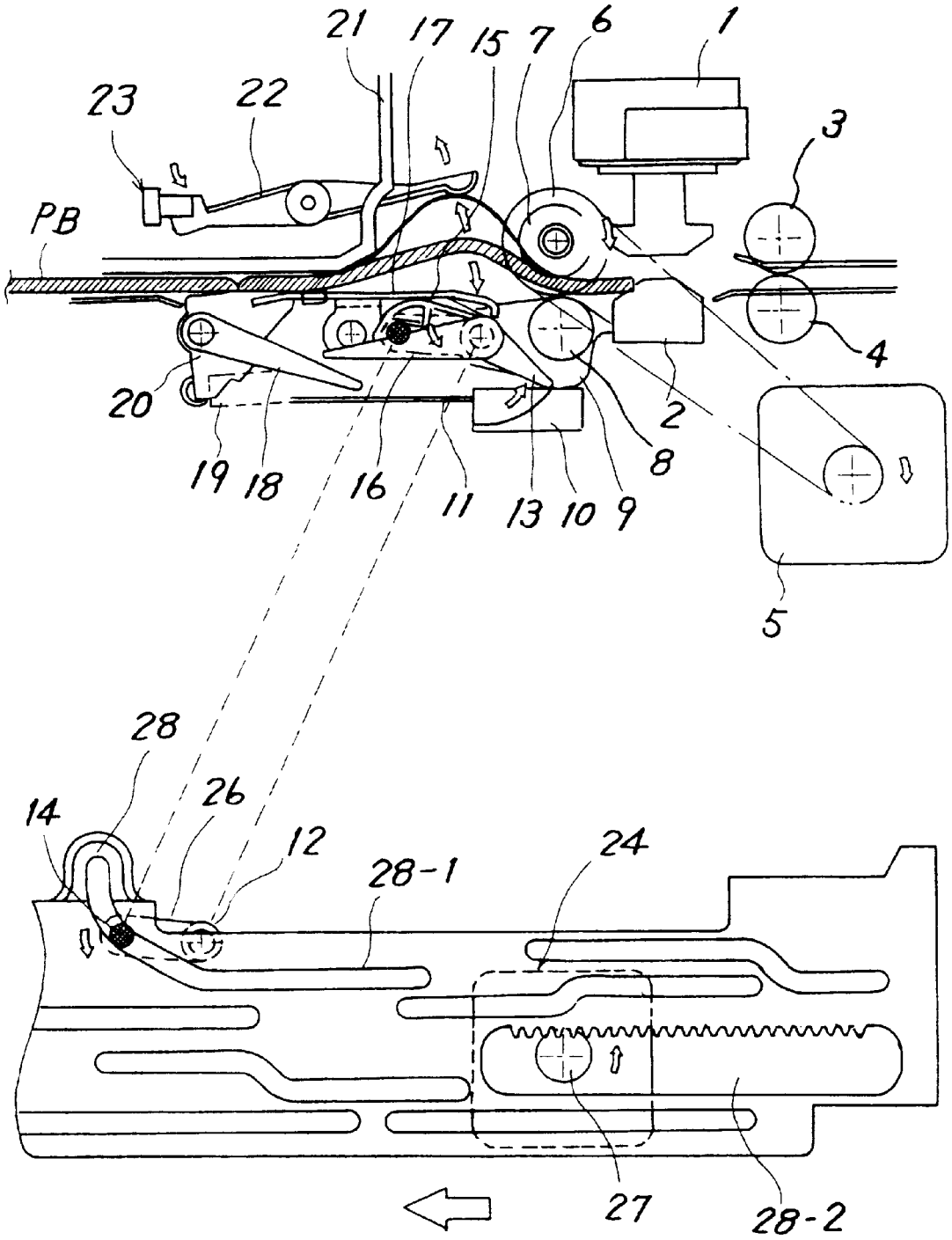
FIG. 7 is an explanatory view showing the operation in one embodiment of the present invention (part 2)
Figure 8:
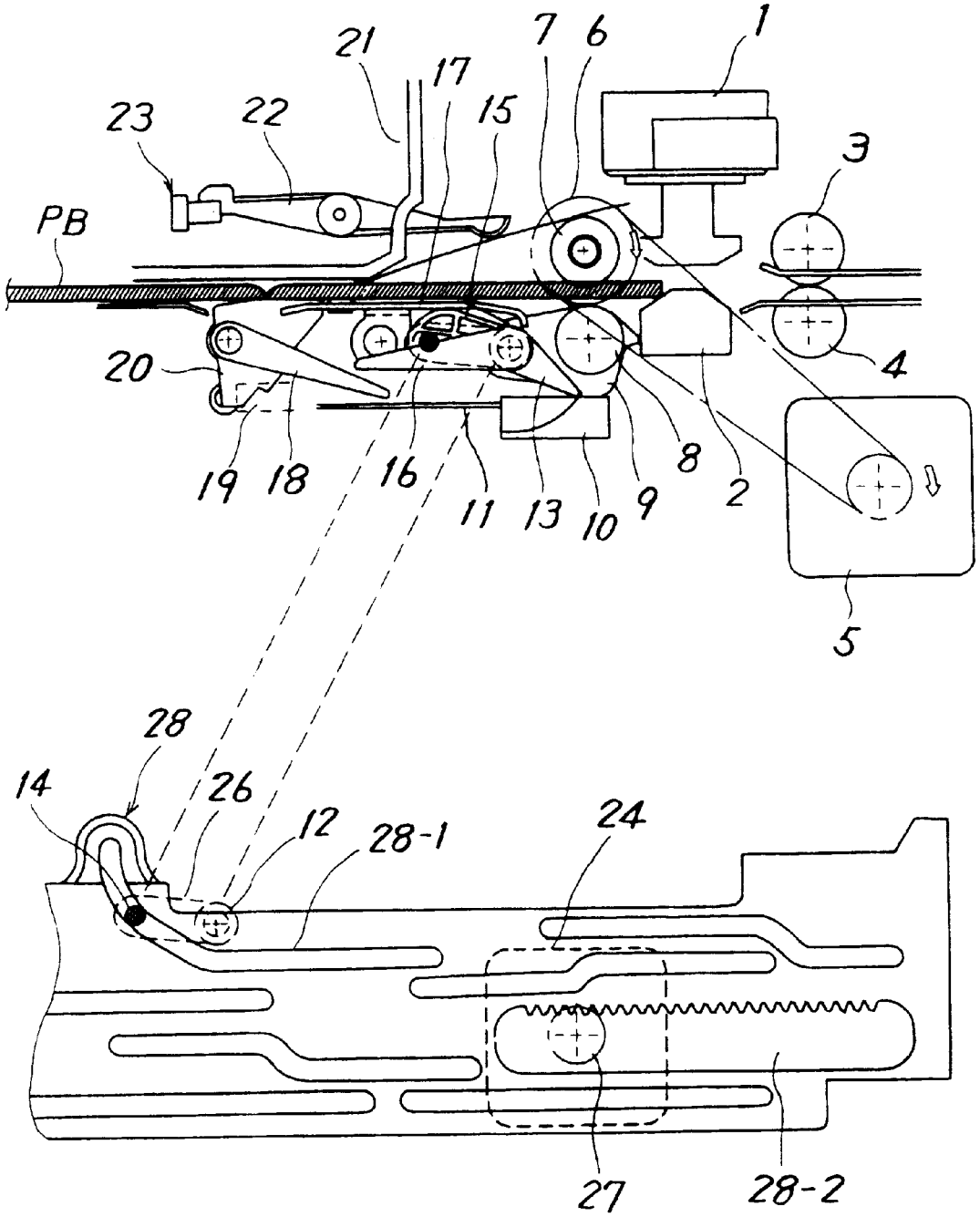
FIG. 8 is an explanatory view showing the operation in one embodiment of the present invention (part 3)
Figure 9:
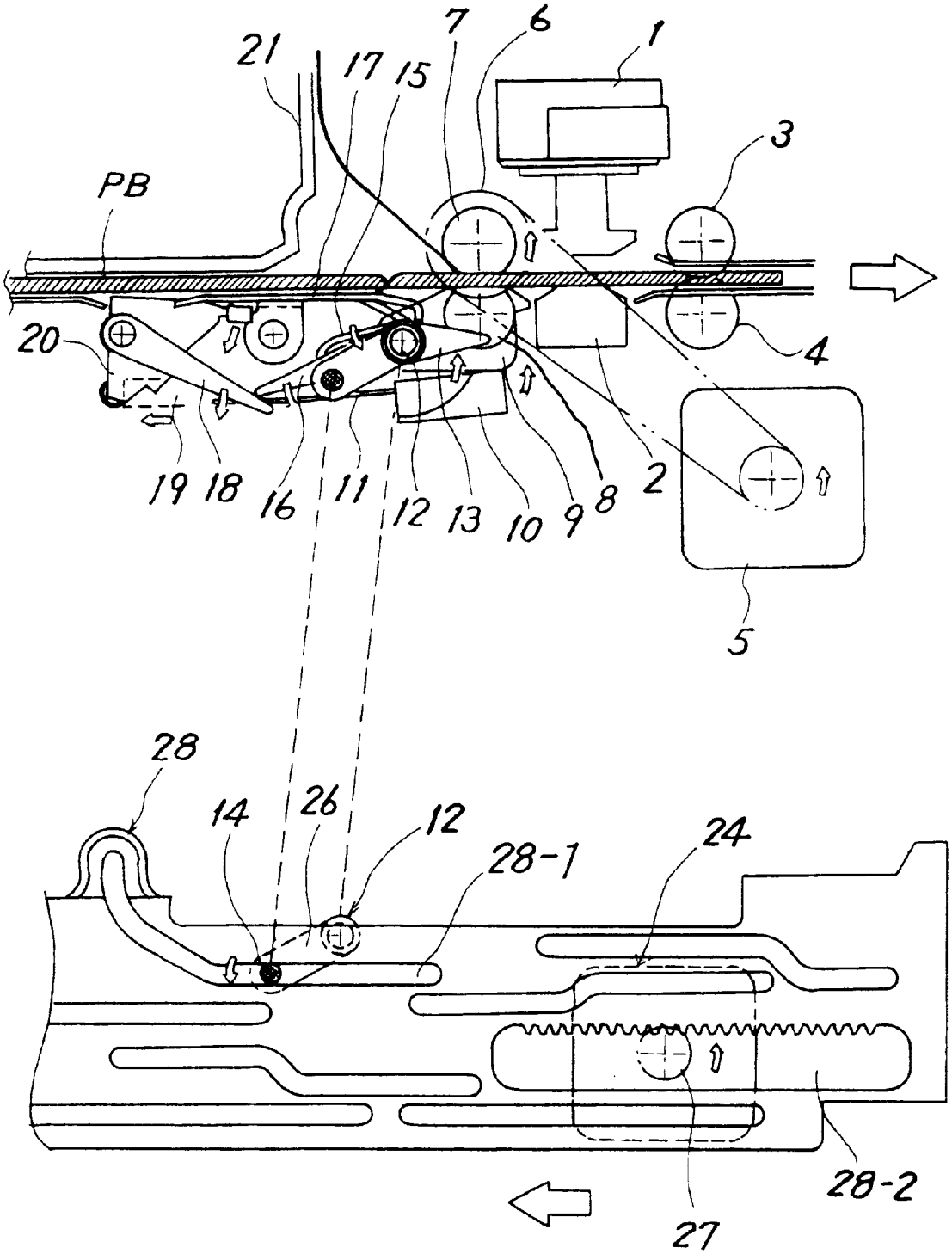
FIG. 9 is an explanatory view showing the operation in one embodiment of the present invention (part 4)
Figure 10:
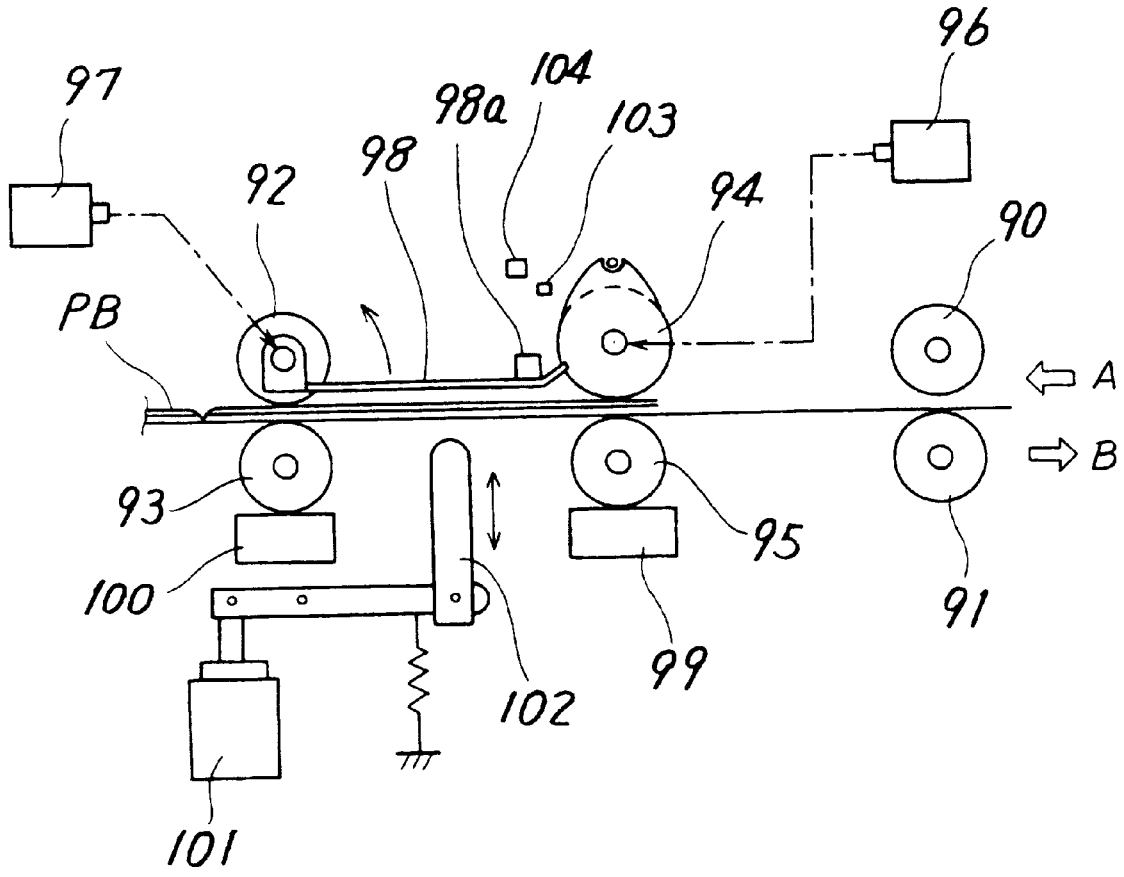
FIG. 10 PRIOR ART
FIG. 10 is an explanatory view showing the prior art.

FIG. 5 is a flowchart showing an operation in accordance with one embodiment of the present invention. FIG. 6 is an explanatory view showing the operation in one embodiment of the present invention (part 1). FIG. 7 is an explanatory view showing the operation in one embodiment of the present invention (part 2). FIG. 8 is an explanatory view showing the operation in one embodiment of the present invention (part 3). FIG. 9 is an explanatory view showing the operation in one embodiment of the present invention (part 4).

(S1) The control unit (hereinafter referred to as a processor) 40, upon receiving a page-turning command, causes the carrier motor 5 to rotate clockwise as shown in FIG. 1. With the rotations of this carrier motor 5, the page turning roller 7 rotates clockwise. At this time, as shown in FIG. 1, the guide member 14 of the drive lever 26 provided on the drive shaft 12 is positioned in a lower portion through the guide hole 28-2 of the plate cam 28. Accordingly, the first lever 13 is positioned so as not to engage with the pressing block 10. Therefore, the pressing block 10 pushes the holder 9 in the upward direction. Consequently, the pinch roller (a tension roller) 8 is pushed against the page turning roller 7.

Similarly, the second lever 15 is disposed in the position shown in FIG. 1, and hence the movable panel 17 descends by its self-weight from a carrier path. Further, the third lever 16 is disposed in the position illustrated in FIG. 1, and therefore presses the fourth lever 18 downward. Consequently, the clamp member 20 descends from the carrier path.

Accordingly, the carrier path is unoccupied, and the pinch roller 8 is pushed against the page turning roller 7. Hence, the banknote PB is carried by the page turning roller 7 in the left direction in FIG. 1.

Next, the processor 40, when the banknote PB reaches a age turning position, halts the carrier motor 5. FIG. 1 shows a state in which the banknote PB stops in the page-turning position. In this state, the page turning roller 7 is located at the edge of the page of the banknote PB.

(S2) The processor 40 drives the cam motor 24 clockwise. As illustrated in FIG. 6, the plate cam 28 is thereby moved in the arrowed direction. Corresponding to the movement of the plate cam 28, the guide member 14 is guided by the guide hole 28-1 and moved upwards. Therefore, the drive shaft 12 rotates clockwise.

With the rotations of this drive shaft 12, the first lever 13 rotates clockwise. Hence, the tip of the first lever 13 engages with the pressing block 10, thus lowering this block 10. The upward pressing force on the holder 9 is thereby released, and the holder 9 descends downward by its self-weight. Consequently the pinch roller 8 moves away therefrom.

Further, with the rotations of the drive shaft 12, the second lever 15 rotates clockwise. The second lever 15 causes the movable panel 17 to rotate counterclockwise. Therefore, the movable panel 17 pushes up an intermediate part of the page of the banknote PB. The banknote PB is thereby bent.

Moreover, with the rotations of the drive shaft 12, the third lever 16 rotates clockwise. As the third lever 16 rotates, the fourth lever 18 is released from being restricted. Hence, the clamp member 20 is rotated counterclockwise by the spring 19. The clamp member 20 is protruded into the carrier path, and the edge of the page of the banknote is sandwiched in between the printer frame 21 and the clamp member 20. The other edge of the page of the banknote PB is thereby clamped.

(S3) Next, as shown in FIG. 7, the processor 40 causes the carrier motor 5 to rotate clockwise. The page turning roller 7 is thereby rotated clockwise. At this time, the pinch roller 8 moved away therefrom, and the other edge of the banknote is clamped. Therefore, the page to be turned swells out due to a frictional force between the page turning roller 7 and the page of the banknote PB.

The sensor lever 22 is rotated by dint of the page of the banknote PB. Then, when sensor lever 22 intercepts the sensor 23 (when the sensor switched ON), it is judged that the page has swollen out to a maximum position of its swelling. The processor 40, when the sensor 23 is switched ON, judges that the swelling of the page reaches the maximum position, and halts the carrier motor 5.

(S4) Next, the processor 40, as shown in FIG. 7, makes the cam motor 24 rotate counterclockwise by a predetermined quantity. With the rotations thereof, the plate cam 28 moves in the left direction in FIG. 7. With this movement, the guide member 14 moves downward while being guided along the guide hole 28-1. The drive shaft 12 is thereby rotated counterclockwise by a predetermined quantity.

With the rotations of this drive shaft 12, the first lever 13 rotates counterclockwise. The tip of the first lever 13, however, engages with the pressing block 10, and hence the pressing block 10 is lowered. consequently the pinch roller 8 is kept in a state of moving away therefrom.

Further, upon the rotations of this drive shaft 12, the second lever 15 rotates counterclockwise. With the rotation thereof, the movable panel 17 rotates clockwise by its self-weight. Therefore, the movable panel 17 descends. The banknote is thereby released from being bent. Consequently, the pages other than the page kept in contact with the page turning roller 7 become flat. Double feeding can be thereby prevented.

Further, with the rotations of the drive shaft 12, the third lever 16 rotates counterclockwise. Even in this state, the third lever 16 releases the fourth lever 18 from its rotational restriction. Hence, the clamp member 20 is protruded by the spring 19 into the carrier path, and the edge of the page of the banknote is sandwiched in between the printer frame 21 and the clamp member 20 itself. The other edge of the page of the banknote PB is thereby clamped.

(S5) The processor 40 causes the carrier motor 5 to rotate clockwise by a predetermined number of steps. With the rotations thereof, the page turning roller 7 rotates clockwise by a predetermined quantity. As illustrated in FIG. 8, at this time the pinch roller 8 moves away therefrom, and the other edge of the banknote is clamped. Therefore, the page, which should be turned over, is leafed up by the frictional force between the page turning roller 7 and the page of the banknote PB.

The sensor lever 22 is rotated by dint of the page of the banknote PB. Then, when sensor lever 22 intercepts the sensor 23 (when the sensor switched ON), it is judged that the page has been leafed up. The processor 40, when the sensor 23 is switched ON, judges that the page has reached a state of its being leafed up.

Thus, the sensor lever 22 directly detects the state of the banknote page being turned over, and the single sensor is capable of detecting the swelling and the leafing-up of the page.

(S6) Next, the processor 40 makes the cam motor 24 rotates counterclockwise by a predetermined quantity as shown in FIG. 9. With the rotations thereof, the plate cam 28 moves in the left direction in FIG. 9. Upon this movement, the guide member 14 is guided along the guide hole 28-1 and further moves downward. Therefore, the drive shaft 12 rotates counterclockwise by the predetermined quantity.

With the rotations of this drive shaft 12, the first lever 13 rotates counterclockwise. The tip of the first lever 13 releases the pressing block 10 from its engagement, and the pressing block 10 resultantly pushes the holder 9 up. Hence, the pinch roller 8 is pressed by the page turning roller 7.

Further, with the rotations of the drive shaft 12, the second lever 15 rotates counterclockwise. With this operation, the movable panel 17 keeps the descendent position.

Moreover, with the rotations of the drive shaft 12, the third lever 16 rotates counterclockwise. The third lever 16 pushes the fourth lever 18 down. Hence, the clamp member 20 rotate clockwise and moves away from the carrier path. The other edge of the page of the banknote PB is thereby released from being clamped.

Next, the processor 40 causes the carrier motor 5 to rotate counterclockwise. With the rotations of the carrier motor 5, the page turning roller 7 rotates counterclockwise. At this time, as shown in FIG. 9, the pinch roller (the tension roller) 8 is pushed against the page turning roller 7.

Similarly, the movable panel 17 descends by its self-weight from the carrier path. Further, the third lever 16 is disposed in a position shown in FIG. 9, and therefore the fourth lever 18 is pressed downward. Hence, the clamp member 20 is lowered from the carrier path.

Accordingly, the carrier path is unoccupied, and the pinch roller 8 is pressed against the page turning roller 7. Therefore, the banknote PB is carried by the page turning roller 7 in the right direction in FIG. 9. Hence, the page leafed up is then turned over. Further, with this operation, the banknote is carried back to the inserting port.

Thus, the edge of the banknote is clamped by the clamping mechanism, and the page turning roller is therefore capable of turning over the page and carrying the banknote. This implies that the single carrier motor is capable of turning over the page and carrying the banknote. The edge of the banknote is clamped by the clamping mechanism protruding into the carrier path, and therefore the clamping operation can be done with a simple construction.

Accordingly, it is feasible to reduce the number of parts, which leads to a decrease in costs. Further, owing to the reduction in the number of parts, the apparatus can be downsized.

Moreover, the clamping mechanism, the bending mechanism (the movable panel mechanism) and the pinch roller retreating/pressing mechanism, are operated by the link mechanism and can be therefore driven by one motor. Accordingly, the number of parts can be further reduced. The link mechanism involves the use of the drive shaft and the lever, and hence the apparatus can be downsized. The link mechanism, because of using the cam, can be constructed at low costs.

Moreover, since the sensor lever comes in direct contact with the page of the banknote, the single sensor is capable of detecting the swelling and the leafing-up of the page. Therefore, the number of parts can be further decreased.

In addition to the embodiment discussed above, the present invention may be modified as follows:

(1) In the embodiment discussed above, the banknote has been exemplified by way of a medium having a plurality of pages bound up, however, the present invention can be applied to other mediums.

(2) The drive mechanism has been explained in the form of the interlocking mechanism, however, an independent non-interlocking mechanism may also be used.

(3) The interlocking mechanism has been explained in the form of the plate cam, however, other link mechanisms are also usable.

(4) The printing mechanism has been described as the printer apparatus for the financial institute, however, the present invention is applicable to printer apparatuses for other applications.

The present invention has been described so far by way of the embodiments but can be modified in a variety of forms within the range of the gist of the present invention, and those modifications are not excluded from the scope of the present invention.

As discussed above, the present invention exhibits the following effects.

(1) The clamping mechanism is used as the mechanism for holding the edge of the medium, and the page turning roller becomes capable of turning over the page and carrying the medium. Accordingly, it is possible to turn over the page and carry the medium by use of the single carrier motor.

(2) Since the edge of the banknote is clamped by the clamping mechanism protruding into the carrier path, the clamping process can be executed with the simple construction.

What is claimed is:

1. A page turning apparatus for turning over a page of a medium, comprising:

a drive roller for turning over a page of the medium and for carrying the medium on a carrier path;

a pressing roller movable between a position in which said pressing roller is positioned away from said drive roller and a position in which said pressing roller is pushed against said drive roller;

a carrier motor for driving said drive roller;

a movable panel movable between a position in which said movable panel is positioned away from a carrier path and a position in which said movable panel protrudes onto the carrier path in order to bend the medium;

clamping means movable between a position in which said clamping means is positioned away from the carrier path and a position in which said clamping means protrudes onto the carrier path in order to clamp the medium;

driving means for driving said pressing roller, said movable panel and said clamping means; and controlling means for controlling said driving means and said carrier motor, wherein said controlling means has:

a page turning mode for controlling said driving means so that said movable panel and said clamping means protrude, and for controlling said carrier motor so as to drive said drive roller, and a carrier mode for controlling said driving means so as to press said pressing roller against said drive roller and retreat said movable panel and said clamping means, and for controlling said carrier motor so that the medium is carried by said drive roller.

2. The page turning apparatus according to claim 1, wherein said driving means includes:

an interlocking member for performing interlocking operations between which said pressing roller, said movable panel and said clamping means; and a single driving source for driving said interlocking member.

3. The page turning apparatus according to claim 2, wherein said interlocking member includes:

a common rotary shaft rotationally driven by said driving source;

a member, provided on said rotary shaft, for driving said pressing roller;

a member, provided on said rotary shaft, for driving said movable panel; and a member for driving said clamping member in accordance with a rotation of said rotary shaft.

4. The page turning apparatus according to claim 3, wherein said driving source includes:

a cam for driving said rotary shaft; and a motor for driving said cam.

5. The page turning apparatus according to claim 1, further comprising:

a frame for clamping the medium between said clamping means and said frame itself.

6. The page turning apparatus according to claim 1, further comprising:

detecting means for detecting a bent page of the medium, wherein said controlling means controls said drive motor in accordance with an output of said detecting means.

7. The page turning apparatus according to claim 6, wherein said controlling means halts said drive motor in accordance with the output of said detecting means, and drives said drive motor in accordance with the output of said detecting means after said movable guide has retreated.

8. The page turning apparatus according to claim 1, wherein the medium is constructed of a banknote containing a plurality of pages.

* * * * *